US009924797B2

(12) United States Patent
Hanlon

(10) Patent No.: US 9,924,797 B2
(45) Date of Patent: Mar. 27, 2018

(54) UTILITY RACK HAVING END SUPPORTS WITH FOLDING CROSS-MEMBERS

(71) Applicant: JS Products, Inc., Las Vegas, NV (US)

(72) Inventor: Jared Hanlon, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 0 days.

(21) Appl. No.: 14/608,648

(22) Filed: Jan. 29, 2015

(65) Prior Publication Data

US 2016/0220017 A1 Aug. 4, 2016

(51) Int. Cl.

| | |
|---|---|
| ***A47B 47/00*** | (2006.01) |
| ***A47F 5/00*** | (2006.01) |
| ***A47B 57/00*** | (2006.01) |
| ***A47B 96/14*** | (2006.01) |
| ***B65B 5/04*** | (2006.01) |
| ***B65B 63/04*** | (2006.01) |
| ***B65B 69/00*** | (2006.01) |
| ***A47F 5/10*** | (2006.01) |
| ***A47B 47/02*** | (2006.01) |
| ***A47B 43/00*** | (2006.01) |

(52) U.S. Cl.

CPC ..... *A47B 96/14* (2013.01); *A47B 43/00* (2013.01); *A47B 47/0083* (2013.01); *A47B 47/021* (2013.01); *A47B 96/1441* (2013.01); *A47F 5/10* (2013.01); *B65B 5/04* (2013.01); *B65B 63/04* (2013.01); *B65B 69/00* (2013.01)

(58) Field of Classification Search

CPC ..... A47B 43/00; A47B 47/021; A47B 47/027; A47B 47/028; A47B 47/0083; A47B 96/1441; A47B 96/1475; A47F 5/10

USPC ..... 211/191, 189, 183, 187

See application file for complete search history.

(56) References Cited

U.S. PATENT DOCUMENTS

| | | | | |
|---|---|---|---|---|
| 2,374,550 | A | | 4/1945 | McIntosh |
| 2,604,213 | A | | 7/1952 | Bales et al. |
| 2,918,176 | A | * | 12/1959 | Bell et al. ..... 211/191 |
| 2,932,368 | A | | 4/1960 | Schell, Jr. |
| 3,042,221 | A | | 7/1962 | Rasmussen |
| 3,072,262 | A | | 1/1963 | Cassel |
| 3,193,060 | A | * | 7/1965 | Park ..... 52/127.5 |

(Continued)

FOREIGN PATENT DOCUMENTS

| | | | | |
|---|---|---|---|---|
| DE | 202012009433 U1 | * | 12/2012 | |
| GB | 2148100 A | * | 5/1985 | ..... A47B 96/14 |

OTHER PUBLICATIONS

Machine Translation of DE202012009433, retrived Jun. 1, 2017, www.espacenet.com.*

*Primary Examiner* — Daniel J Troy
*Assistant Examiner* — Kimberley S Wright

(57) ABSTRACT

A utility rack includes a pair of end supports for supporting one or more shelves there between. Each end support includes a first vertical support having one or more cross members mounted thereto and a second vertical support. The cross members may be mounted to one or more cross member mounts of the first vertical support and are configured to be movable relative to the first vertical support between a stored position in which they are disconnected from the second vertical support and are collapsed inwardly towards the first vertical support for storage or transport and an extended position in which free ends of the cross members may be attached to the second vertical support using fasteners.

3 Claims, 3 Drawing Sheets

(56) References Cited

U.S. PATENT DOCUMENTS

| | | | | | |
|---|---|---|---|---|---|
| 3,194,407 | A | * | 7/1965 | D Altrui | 211/191 |
| 3,221,894 | A | | 12/1965 | Knuth | |
| 3,235,038 | A | * | 2/1966 | Nesslinger | 182/62.5 |
| 3,475,044 | A | * | 10/1969 | Konstant | 403/217 |
| 3,625,372 | A | * | 12/1971 | MacKenzie | 211/191 |
| 3,741,405 | A | | 6/1973 | McConnell et al. | |
| 3,900,111 | A | | 8/1975 | Hiler et al. | |
| 3,986,462 | A | | 10/1976 | Heft | |
| 4,078,664 | A | | 3/1978 | McConnell | |
| 4,088,229 | A | * | 5/1978 | Jacoby et al. | 211/191 |
| 4,236,642 | A | * | 12/1980 | Klein | 211/207 |
| 4,262,809 | A | * | 4/1981 | McConnell | 211/192 |
| 4,423,817 | A | * | 1/1984 | Monjo-Rufi | 211/187 |
| 4,648,517 | A | * | 3/1987 | Schafer | 211/183 |
| 5,012,938 | A | * | 5/1991 | King | 211/191 |
| 5,190,171 | A | | 3/1993 | Christman, Jr. | |
| 5,194,407 | A | | 3/1993 | Waisala et al. | |
| 5,263,296 | A | * | 11/1993 | Spera | 52/638 |
| 5,845,795 | A | | 12/1998 | Mulholland | |
| 6,223,494 | B1 | * | 5/2001 | Bright | 52/653.1 |
| 6,510,955 | B2 | | 1/2003 | Pellegrino | |
| 7,128,225 | B2 | | 10/2006 | Saltzburg et al. | |
| 7,252,202 | B2 | | 8/2007 | Saltzberg et al. | |
| 7,365,268 | B2 | | 4/2008 | Collins et al. | |
| D569,143 | S | | 5/2008 | Liss et al. | |
| D571,133 | S | | 6/2008 | Liss et al. | |
| D571,589 | S | | 6/2008 | Liss et al. | |
| D572,053 | S | | 7/2008 | Liss et al. | |
| D572,054 | S | | 7/2008 | Liss et al. | |
| D585,680 | S | | 2/2009 | Liss et al. | |
| D585,681 | S | | 2/2009 | Liss et al. | |
| D585,682 | S | | 2/2009 | Liss et al. | |
| D587,046 | S | | 2/2009 | Liss et al. | |
| D597,353 | S | | 8/2009 | Liss et al. | |
| D597,354 | S | | 8/2009 | Liss | |
| D604,537 | S | | 11/2009 | Liss et al. | |
| D604,538 | S | | 11/2009 | Liss et al. | |
| 7,748,546 | B2 | * | 7/2010 | Konstant | 211/191 |
| 7,753,220 | B2 | * | 7/2010 | Konstant | 211/191 |
| 8,172,098 | B2 | | 5/2012 | Eustace | |
| 8,302,788 | B2 | * | 11/2012 | Vargo et al. | 211/186 |
| 8,443,992 | B2 | * | 5/2013 | Lawson et al. | 211/190 |
| 8,960,451 | B2 | * | 2/2015 | Florence et al. | 211/26 |
| 2004/0045921 | A1 | * | 3/2004 | Muller | 211/187 |
| 2006/0144809 | A1 | | 7/2006 | Collins et al. | |
| 2006/0163438 | A1 | | 7/2006 | Wojotowicz et al. | |
| 2006/0196842 | A1 | | 9/2006 | Taylor et al. | |
| 2008/0145197 | A1 | | 6/2008 | Taylor et al. | |
| 2008/0173603 | A1 | * | 7/2008 | Dion | 211/182 |
| 2008/0265728 | A1 | | 10/2008 | Collins et al. | |
| 2008/0272266 | A1 | | 11/2008 | Eustace et al. | |
| 2009/0277854 | A1 | | 11/2009 | Eustace et al. | |
| 2009/0278004 | A1 | | 11/2009 | Eustace et al. | |
| 2012/0067838 | A1 | * | 3/2012 | Lawson et al. | 211/134 |
| 2015/0090683 | A1 | * | 4/2015 | Sabounjian | 211/186 |

* cited by examiner

UTILITY RACK HAVING END SUPPORTS WITH FOLDING CROSS-MEMBERS

BACKGROUND

1. Field

The disclosed embodiments relate to shelving systems. More specifically, the disclosed embodiments relate to utility rack end supports.

2. Related Art

Many shelving or rack systems are commercially available that may be installed in a home, office, garage, warehouse, or other facility to provide storage. Such shelving systems are generally comprised of a number of shelves which are supported by end supports. The end supports are generally framed structures that include vertical members joined by one or more connecting members (such as shelf supports) to provide sufficient strength and rigidity for securely supporting the shelves and the contents placed thereon.

Typically, such end supports are fabricated as a unitary structure. That is, the vertical supports and connecting members are permanently fixed to one another, such as by welding. In this manner, the end supports can provide sufficient rigidity and strength to support the shelving system. This is largely due to the fact that with welded connecting members there is no play between the vertical supports and the connecting members.

While the above described end supports are strong and rigid, they may also be unwieldy for storage, packaging, and transporting. Because the above-described end supports are of a fixed, rigid structure, packaging for a shelving system or utility rack utilizing the end supports must be of sufficient size to accommodate those unitary end supports. For example, the vertical supports may be spaced apart from one another by 18-24 inches or more, requiring that the associated packing be at least 18-24 inches wide to accommodate those supports. This leads to a large packaging size for the shelving systems, which in turn requires more storage space at a manufacturer's warehouse, during shipping, on display at a retail location, and for an end user to transport to an installation location. This additional required storage space increases overhead costs for a manufacturer, including added storage facility costs and shipping fees.

Alternatively, "unassembled" storage shelving and utility racks have been developed. These storage shelving and utility racks use end supports which are produced, shipped, and sold with the vertical members and connecting members comprising entirely disassociated individual members. The members include preconfigured connectors which allow the members to be connected or joined to one another to assemble the unit. This configuration allows the members to be stacked or positioned close to one another during shipping and storage, reducing the amount of space as compared to a rack that has cross supports welded to the vertical end members.

However, in these shelving systems, a purchaser of the rack or shelving system is required to assemble all of the various pieces of the end supports. This may require substantial time and effort of the part of the purchaser, discouraging the purchaser to buy such a product. The user may also incorrectly assemble the end supports, thus causing them to not function as intended. Further, the resulting shelving may not provide sufficient strength and rigidity as compared to a rack with welded end supports. For example, the integrated connectors for the end members generally comprise pins or tabs on one member which are accepted into slots in a corresponding member. The effectiveness of the pin and slot connector configuration depends upon exact alignment or else substantial play is introduced at both ends of all of the cross supports and the vertical supports, thus allowing the shelf or rack to tilt or sway or become unstable. Furthermore, a shelf support is often used as the connector member for the end supports which dictates and limits the placement of at least that shelf member, thus preventing the user from being able to select the desired location of all the shelves. The present invention eliminates that limitation.

Thus, there exists a need for utility rack having end supports that allow for reduced packing size for shipping and storage while retaining sufficient strength, rigidity, and ease of assembly during use.

SUMMARY

The disclosed embodiments have been developed in light of the above. Aspects of the invention comprise a "bolted" utility rack comprising at least two end supports for supporting one or more shelves or other supporting elements. Each end support comprises a first vertical support having one or more cross members mounted thereto and a second vertical support. In a preferred embodiment, the first vertical support includes two or more cross member mounts and first ends of the cross members are fastened or permanently affixed to those cross member mounts. The one or more cross members are configured to be movable between a first extended position for connection via one or more fasteners to the second vertical support and a second collapsed or a storage position in which the cross members are disconnected from the second vertical support and are positioned substantially parallel to the first vertical support. The second vertical support preferably includes two or more cross member mounts to which free ends of the cross members may be attached using fasteners.

According to further aspects of the invention, the first vertical support of the end support of the utility rack may be constructed to have a channel. In the stored position, at least one of the cross members may be disposed at least partially within the channel of the first vertical support.

The cross support mounts may comprise brackets that are installed within or otherwise connected to the channels of the first and second vertical supports. The cross members may comprise, when extended from the first vertical support and connected to the second vertical support, at least one horizontal cross member and at least one diagonal cross member. The at least one horizontal cross member and the at least one diagonal cross member may be connected to the same cross support mount of the first vertical support.

The cross members preferably include an upper horizontal cross member, a lower horizontal cross member, and a diagonal cross member. The diagonal cross member and the lower horizontal cross member may be connected to a common lower cross member mount of the first vertical support, while the upper horizontal cross member may be connected to an upper cross member mount of the first vertical support. The free end of the lower horizontal cross member may be configured to connect to a lower cross member mount of the second vertical support and the free ends of the diagonal cross member and the upper horizontal cross member may be configured to connect to an upper cross member mount of the second vertical support.

Further aspects of the invention may include a method for packaging a rack and/or an end support for a utility rack, and for assembling an end support and rack. In one embodiment of a method of packing, the plurality of cross members are disconnected from the second vertical support and are folded to position in which the plurality of cross members are substantially parallel with the first vertical support, and the first and second vertical supports with the plurality of cross members in the folded position are packaged for storage and shipping. In a method of assembly, the components of the rack are removed from a package. The cross members of each first vertical support are rotated into their extended position and connected to the second vertical supports to form two rack end supports, preferably using fasteners comprising bolts. One or more shelves are connected to the end supports to be supported thereby. Advantageously, the shelves can be positioned independent of the cross members because the shelves/shelf supports do not serve as cross supports for the end members.

Further objects, features, and advantages of the present invention over the prior art will become apparent from the detailed description of the drawings which follows, when considered with the attached figures.

BRIEF DESCRIPTION OF THE DRAWINGS

FIG. 3A shows the vertical supports in a stored condition, FIG. 3B shows the vertical supports with cross members moving towards an assembled position, and FIG. 3C shows the vertical supports and cross members in an assembled position.

DETAILED DESCRIPTION OF EMBODIMENTS

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is a utility rack with end supports having folding cross members. The utility rack with these end supports allows for compact packaging and storage, easy assembly and high rigidity and strength when fully assembled.

Figure 1:
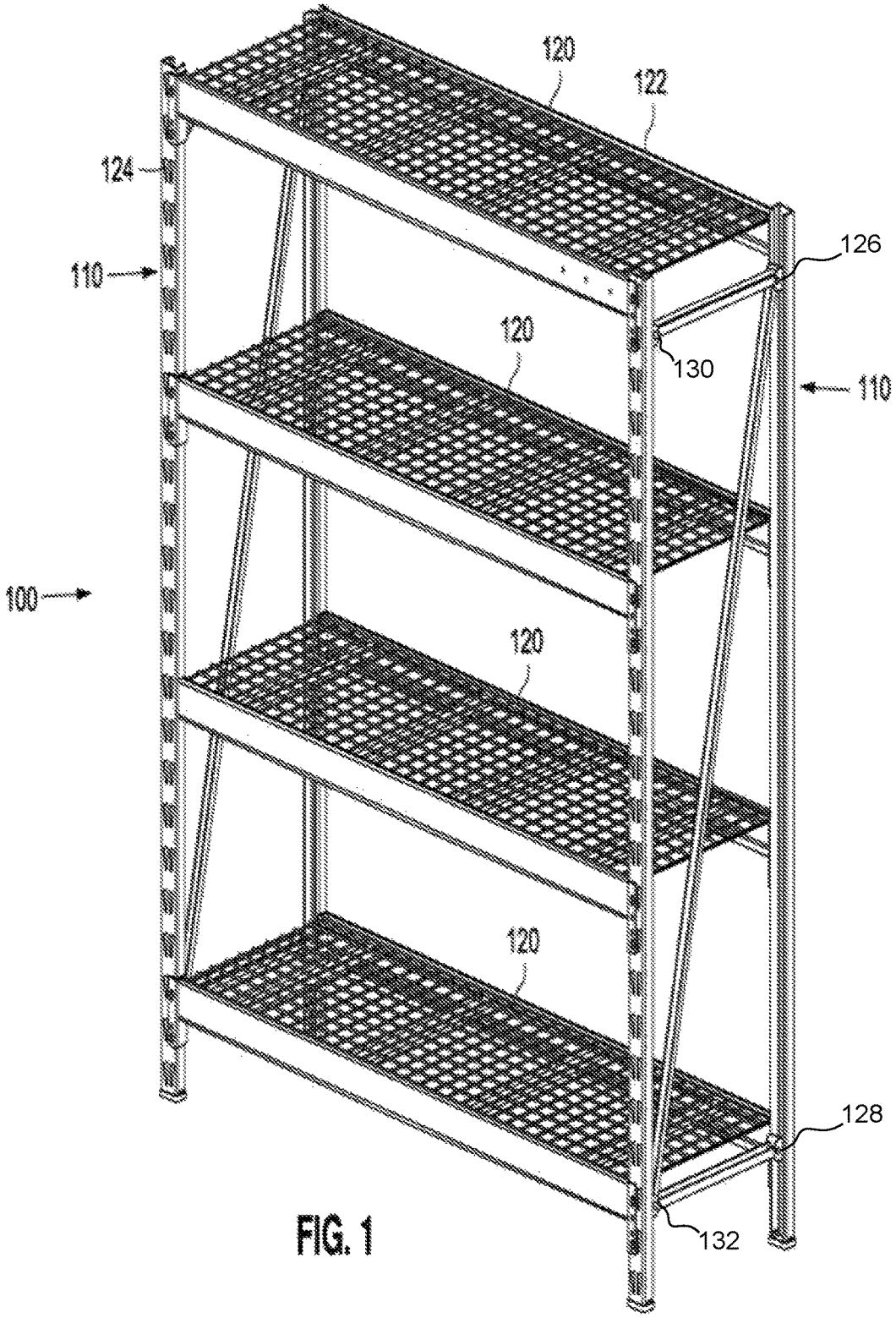
FIG. 1 is a utility rack that includes end supports according to one embodiment of the invention.

FIG. 1 illustrates one embodiment of a utility rack 100 that includes end supports according to one embodiment of the invention. In this embodiment, the utility rack 100 is configured as a shelving unit. The utility rack 100 includes two end supports 110. The end supports 110 are configured to support a plurality of shelves 120 therebetween. The shelves 120 may be removably connectable at various locations on the end supports 110. The shelves 120 may be of unitary construction or may include a storage surface that is connected to shelf supports 122. The connection between the shelves 120 and the end supports 110 may be by various connections or connectors. The number of shelves 120, their configuration and spacing, may vary. For example, the position of the shelves 120 may be varied by the user. It will be appreciated that the utility rack 100 could have other configurations. For example, the rack 100 might be configured as a pallet rack and have two end supports 110 and a plurality of pallet supporting beams extending there between, or the like.

Figure 2A:
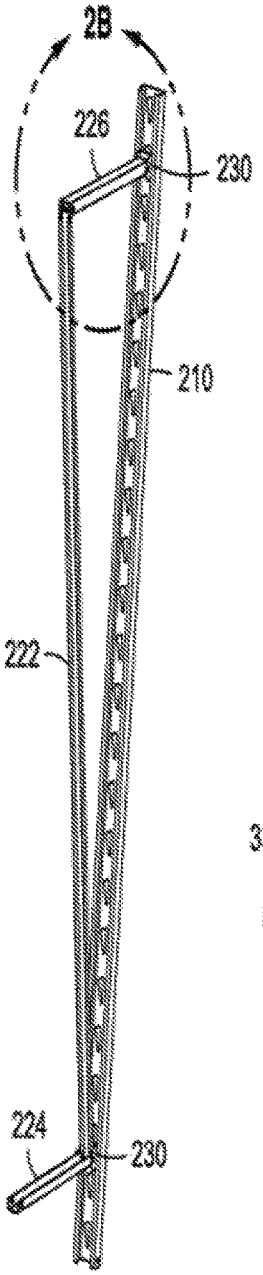
FIG. 2A is a vertical support of the end supports of the utility rack shown in FIG. 1 with folding cross members.
Figure 2C:
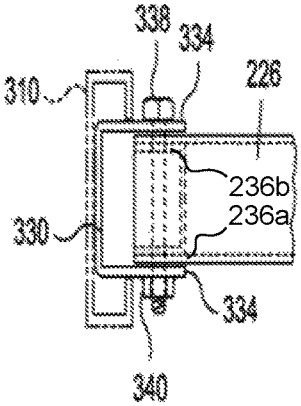
FIG. 2C is a top view of a connection of cross members to a vertical support via a member mount and fasteners.
Figure 2B:
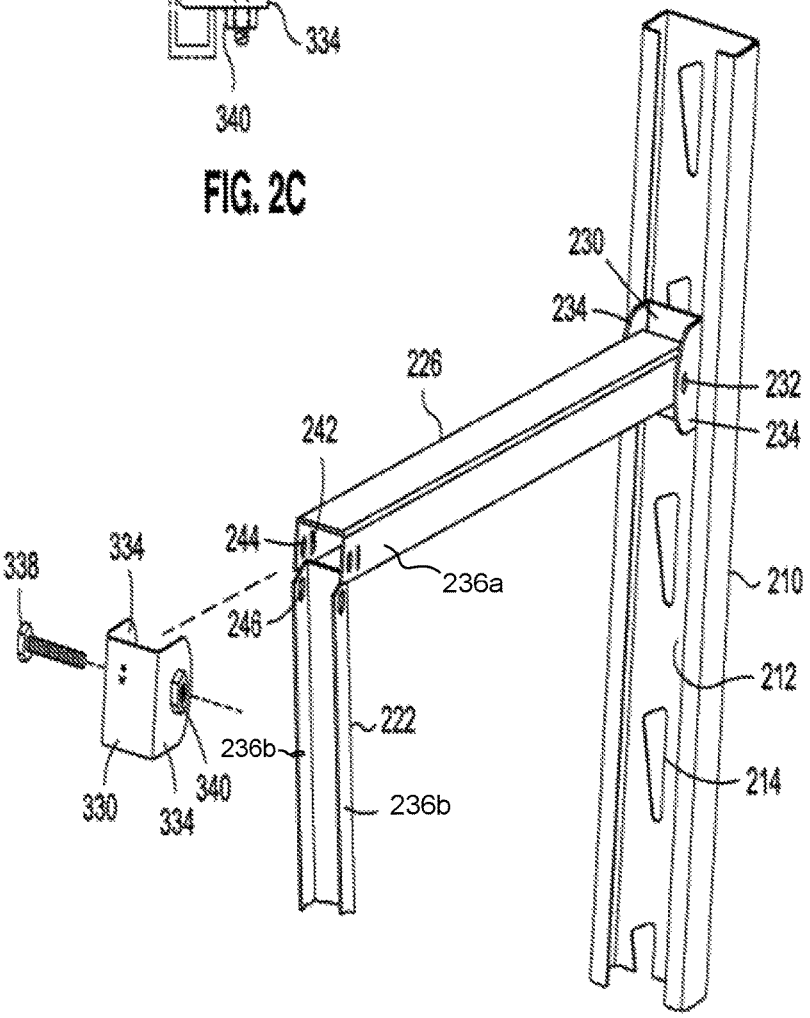
FIG. 2B is an enlarged view of a portion of the folding cross members, member mounts and associated fasteners shown in FIG. 2A.

In one embodiment of the invention, each end support 110 of the rack 100 comprises two vertical supports and one or more cross-members. In an embodiment, the one or more cross-members couple, variously, to the two vertical supports at a first attachment point 126, a second attachment point 128, a third attachment point 130, and a fourth attachment point 132. FIG. 2A illustrates a first vertical support 210 of one of the end supports 110 of the utility rack 100 illustrated in FIG. 1. FIG. 2B is an enlarged view of a portion of the first vertical support 210 and a connection of one of the cross members shown in FIG. 2A.

The first vertical support 210 includes one or more cross members 222, 224, 226. As described below, the cross members 222, 224, 226 are designed to be movable between a first collapsed position and a second extended position. In the second extended position, the cross members are connectable to a second vertical support to form a rack end support 110.

As shown in FIGS. 2A and 2B, the first vertical support 210 is an elongate member having first and second ends. In one embodiment, the first vertical support 210 is generally "C"-shaped in cross-sectional shape, thus defining a channel 212 along the length thereof. The first vertical support 210 may include a plurality of attachment points or elements. For example, the first vertical support 210 may include a plurality of apertures 214. The apertures 214 may be formed by punching out a section of the vertical support 210 to form tabs 124 (see FIG. 1). As illustrated in FIG. 1, mounts of the shelves 120 may be configured to connect to the tabs 124 to support the shelves 120, in a manner that is well known in the art. The first vertical support 210 might also include catches, hooks, pins or other elements to facilitate the attachment of the shelves 120 or other elements.

The cross members 222, 224, 226 are mounted to the first vertical support 210, and most preferably are permanently affixed or connected to the first vertical support 210. At the same time, the cross members 222, 224, 226 are configured to be foldable or pivotable relative to the first vertical support 210. In one embodiment, the cross members 222, 224, 226 are mounted to the vertical supports by one or more cross member mounts or other attachment mechanisms. Particularly, brackets 230 or other mounts are provided that are mounted or connected to the first vertical support 210. In one embodiment, the brackets 230 include tabs or other elements which connect to one or more of the fastening apertures 214 in the channel 212 of the vertical support 210. The brackets 230 may be fixed to the fastening apertures 214 via any suitable connection providing sufficient strength and rigidity such as by a force fit, fasteners, and the like. Alternatively, the brackets 230 may be welded within the channel 212 of the first vertical support 210, or may be formed integrally with the first vertical support 210.

In a preferred embodiment, each bracket 230 includes a pair of spaced flanges 234 each having an aperture 232 configured to receive at least one fastener. The fastener, such as a pin, bolt or the like may be configured to extend through the apertures 232 and corresponding apertures in a first end of the cross members 222, 224, 226. The pin may be force fit into the apertures 232 to secure the pin to the bracket 230, or the pin may be a bolt that has a corresponding nut to secure the pin to the bracket 230. It is also possible to utilize two pins, each of which engages one of the flanges and one portion of the first end of the cross members 222, 224, 226. The rotatable connection between the cross members 222, 224, 226 and the brackets 230 allows the cross member 222, 224, 226 to rotate or fold with respect to the first vertical support 210.

In this embodiment, there is a lower horizontal cross member 224, an upper horizontal cross member 226, and a diagonal cross member 222. In a preferred embodiment, each cross member 222, 224, 226 is also general "U" or "C" shaped in cross-sectional shape, thus including a pair of spaced apart walls 236. The cross members 222, 224, 226 are sized so that the spaced walls 236 fit tightly adjacent to the spaced flanges 234 of the brackets 230. In a preferred embodiment, the dimension between the outside of the walls 236 of the cross member is slightly smaller than the distance between the flanges 234 of the bracket 230, whereby the end of the cross member may fit within or between the flanges 234 of the bracket 230, as illustrated in FIG. 2B.

Figures 3A, 3B, 3C:
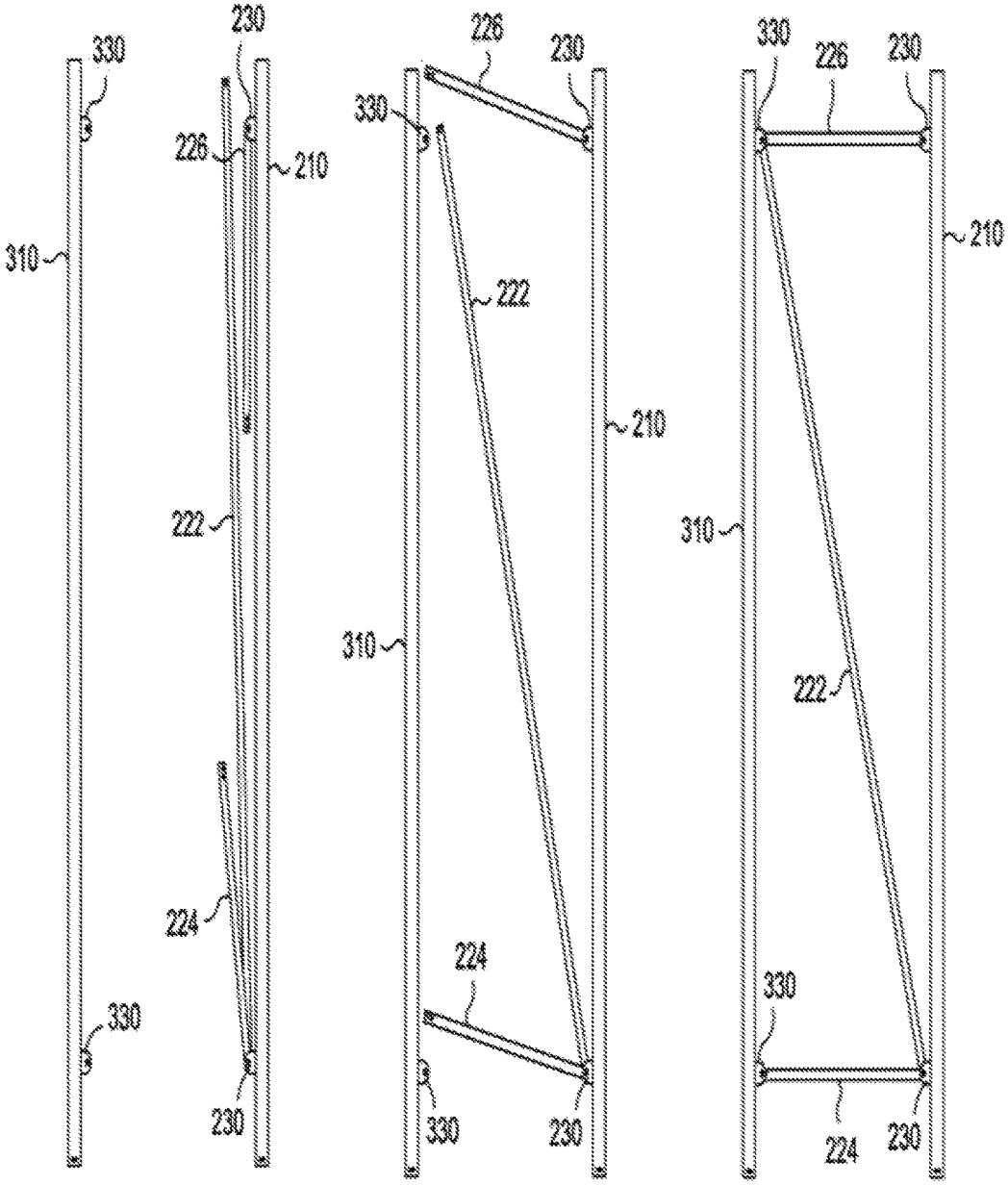
FIGS. 3A-3C show an example of assembling two vertical supports with the folding cross members shown in FIGS. 2A and 2B.

In one embodiment, a first end of the lower horizontal cross member 224 and a first end of the diagonal cross member 222 are permanently attached to the first vertical support 210 at a first position via a first bracket 230, and a first end of the upper cross member 226 is permanently attached to the vertical support 210 at a second position via a second bracket 230, as shown in FIG. 2A. The other second or free ends of the cross members 222, 224, 226 include apertures 244 and 246 that are configured for use in attaching these members to a second vertical support 310, as illustrated in FIG. 3A and described in more detail below. In this embodiment, apertures 246 and 244 of the diagonal cross member 222 and the upper cross member 226 are configured to be attached to the second vertical support 310 at the same location. The upper cross member 226 further includes guiding tabs 242 that project from an inner channel surface of the upper cross member 226 to facilitate easy assembly of the diagonal cross member 222 and upper cross member 226.

As indicated, each end support 110 of the rack 110 preferably also includes a second vertical support 310. In a preferred embodiment, the second vertical support 310 also comprises an elongate member having a first end and a second end. The second vertical support 310 may also include one or more attachment points or members, such as for attaching the shelving 120 or shelving supports 122. Preferably, the second vertical support 310 does not include any cross members. Instead, the second vertical support 310 only includes one or more brackets 330 or similar members to which the free ends of the cross members 222, 224, 226 of the first vertical support 210 may be selectively connected and disconnected (i.e. the end supports 110 include means for removably connecting the cross members 222, 224, 226 to the second vertical support 310), as described below.

FIGS. 3A-3B show an example method of assembling and end support 110 for a rack 100 of the invention. As explained above, the first vertical support 210 is constructed so that while the cross members 222, 224, 226 are fixed to the first vertical support 210, they are also movable relative to the first vertical support 210. In particular, during storage and shipping as shown in FIG. 3A, the cross members 222, 224, 226 may be moved to a first or stored position. In this position, the cross members 222, 224, 226 are folded or moved to a position in which they extend generally parallel with the first vertical support 210.

As illustrated in FIG. 3A, the free ends of the cross members 222, 224, 226 may be disconnected from the second vertical support 310. The upper cross member 226 may be folded down towards the middle of the first vertical support 210, and the diagonal cross member 222 and the lower cross member 224 may be folded up towards the middle of the first vertical support 210. When the first vertical support 210 defines a channel, the cross members 222, 224, 226 may be configured to fold such that one or more of the cross members 222, 224, 226 (or portions thereof) rest within the channel 212 of the vertical support 210. The position of the vertical support 210 and cross members 222, 224, 226 shown in FIG. 3A may be referred to as a folded position for packaging, storing, and shipping. In this position, because the second vertical support 310 is not connected to the first vertical support 210 and because the cross members 222, 224, 226 are folded down, the second vertical support 310 may be placed directly adjacent to the first vertical support 210 (i.e. the second vertical support 310 does not need to be spaced outwardly from the first vertical support 210, such as is the case with welded end supports of the prior art). In this position, the position the first and second vertical supports 210, 310 and associated cross members 222, 224, 226 take up considerably less space for storage and shipping as compared to a configuration where the cross members are welded to both vertical supports, thus causing those supports to be spaced from one another by the cross-members As shown in FIG. 3B, to assemble the end support 110, the cross members 222, 224, 226 are unfolded for connection with corresponding brackets 330 on the second vertical support 310. That is, the lower cross member 224 is folded downwardly so that the free end thereof is aligned with a lower bracket 330 of the second vertical support 310. In this position, the lower cross member 224 may be in a horizontal position between the first and second vertical supports 210, 310. Similarly, the diagonal cross member 222 is folded outwardly so as to extend from a lower bracket 230 on the first vertical support 210 to an upper bracket 330 on the second vertical support 310. Further, the upper cross member 226 is folded upwardly to connect to the upper bracket 330. In this position, the upper cross member 226 may be in a generally horizontal position between the first and second vertical supports 210, 310.

The free ends of the cross members 222, 224, 226 are connected to the brackets 330 of the second vertical support 310. The brackets 330 may be similar to the brackets 230 described above (such as having a pair of flanges 334 which have apertures therein). Various means may be used to connect the cross members 222, 224, 226 to the second vertical support 310. Referring to FIGS. 2B and 2C, in the preferred embodiment, one or more fasteners (e.g. one or more elements separate from the cross members or the second vertical support) are utilized to connect the cross members 222, 224, 226 to the second vertical support 310. The fastener(s) may comprise one or more pins or other elements. In a most preferred embodiment, the fasteners comprise fasteners which allow customization of the tightness of the connection, such as a bolt 338 and corresponding nut 340 (such as by extending a bolt 338 through the apertures in the cross members and the associated bracket 330 and securing the bolt with a nut 340, which nut may be mounted on the bracket 338 (such as via welding or by threading the aperture of the bracket 330, etc.)), thus allowing the user to ensure that even though there may be variances in each connection, such as due to manufacturing variation in the members, the connection of each cross member to the second vertical support 310 is tight and secure. The assembled end support 110 is shown in FIG. 3C. As depicted in FIG. 2C, at least one of the cross members is formed with walls 236 that are spaced apart or sized to receive another of the cross members. For example, the dimension between the walls 236*a* of the upper horizontal cross member 226 may be greater than the outside dimension of the walls 236*b* of the diagonal cross member 222. As such, at least a portion (e.g., an end) of the diagonal cross member 222 may be partially inserted or nested into the upper horizontal cross member 226.

Referring to FIG. 1, once the user has assembled the two end supports 110, the user may use them to support one or more shelves 120 or other members. As indicated above, the user may connect the shelves 120 to the end supports 110 via the provided connectors, such as by aligning slots on the shelves/shelf members with pins 124 on the end supports 110. A particular advantage of the invention is that the location of the cross members 222, 224, 226 is entirely independent of the shelves 120. In particular, unlike the prior art, the user can locate the shelves 120 in any position because the shelves/shelf supports do not serve as connecting or supporting members for the end supports 110. Instead, dedicated cross members 222, 224, 226 are used to connect and support the vertical supports 210, 310 of the end supports 110. This allows the user to place the shelves 120 at any desired position along the end supports 110.

The first vertical support 210 with integral cross members 222, 224, 226 and the separate/separable second vertical support 310 allows the end support 110 of the shelving system 100 to be collapsed or separated, thus requiring less space for packaging, storing, and shipping. Further, the end support 110 formed from the first vertical support 210 having integral cross members 222, 224, 226 and connectable second vertical support 310 maintains sufficient strength and is ease of assembly. Particularly, because the cross members 222, 224, 226 are mounted or permanently affixed to the vertical support 210, the cross members 222, 224, 226 are both securely connected to the first vertical support 210 while also being foldable or rotatable with respect to the vertical support 210.

The end support 110 provides a number of advantages or prior end supports. Because the end support 110 includes foldable cross members 222, 224, 226, the end support 110 requires considerably less storage space than prior end supports. This decreases storage costs such as packing and inventory costs as well as shipping costs. The smaller packaging size may also be more convenient for an end purchaser to transport the rack 100 to an installation location. Further, because the vertical support 210 is fabricated or constructed with integral cross members 222, 224, 226, the end support 110 is easy to assemble. As described above, all the user needs to do to assemble the rack 100 is to form each end support 110 by folding out the cross members 222, 224, 226 from the first vertical support 210 and attaching them to the second vertical support 310, and then connecting the shelves 120 to the end supports 110. The assembly of the end supports 110 is obvious because the first ends of the cross members 222, 224, 226 are already mounted to the first vertical support 210, such that the free ends can only be rotated out to one position where they align with the brackets 330 of the second vertical support 310. All the user needs to do is simply pin or otherwise connect the free ends of the cross members to the second vertical support 310.

At the same time, because the foldable cross members 222, 224, 226 are already installed onto the vertical support 210, they are mounted in a manner which maximizes strength while minimizing free play, thus ensuring that the end supports 110 are strong and rigid when assembled. In particular, in the preferred configuration, the brackets 230, 330 have outwardly extending spaced flanges 234. Opposing walls 236 or portions of the free ends of the cross members 222, 224, 226 are mounted to those flanges, thus reducing the play between the cross members 222, 224, 226 and the first vertical support 210 (e.g. keeping the cross members 222, 224, 226 aligned therewith). Further, unlike "boltless" racks of the prior art, the configuration of the invention which requires fasteners to connect the members ensures that connected members are tightly connected to one another, eliminating play between those members.

The above described embodiment is an example implementation and does not limit the scope of the invention. Further modifications of the shelving unit incorporating the above features are also envisaged. For example, while the above shelving unit comprises brackets 230, 330 for connecting the cross members 222, 224, 226 to the vertical support 210, the invention is not limited to this. Instead of the bracket 230, 330, installation apertures for connecting to the cross members 222, 224, 226 may be built into the sidewalls of the channel 212 of the vertical member 210.

It will also be appreciated that other forms of rotating connections might be utilized between the cross members 222, 224, 226 and the first vertical support 210. For example, the brackets 230 of the first vertical support 210 might carry bearing mounted rods to which the cross members are connected. In one embodiment, pins might actually extend through the sides of the first vertical support 210 itself (rather than through brackets 230) for rotatably mounting the cross members 222, 224, 226.

The invention is not limited to the configuration of cross members 222, 224, 226 described above. For example, there may be fewer cross members (such as a single diagonal cross member, or just one or more horizontal cross members) or additional horizontal and/or diagonal cross members based on the size and strength of the desired end support. For example, an end support 110 might include a first vertical support having upper, intermediate and lower cross members which can fold for storage or extend into a generally horizontal position for connection to the second vertical support.

It will also be appreciated that the mounting points for the cross members 222, 224, 226 may vary. In one embodiment, the diagonal cross member 222 might be connected to the upper bracket 230 along with the upper cross member 226, so that the diagonal cross member 222 must be rotated upwardly to connect to the second vertical support. Also, the first end of the diagonal cross member 222 need not be the same as either horizontal cross member.

Further, the spacing between the brackets and/or their location (from the ends of the first vertical support 210) may vary. Also, the location of the brackets 330 of the second vertical support 310 may vary. In one embodiment, it is possible for the brackets 330 to be offset from the brackets 230 of the first vertical support 210, whereby the upper and lower cross members 224, 226 do not extend horizontally, but slope. The cross members may each be connected to a single bracket or installation aperture, or two or more cross members may be connected to a single bracket or installation aperture.

While the rack 100 of the invention comprises two end supports 110 and one or more intermediate members such as shelves 120, other elements or units could be connected to or added onto the rack 100. For example, in one embodiment the rack 100 might comprise first and second end supports and one or more intermediate supports. Shelves or other elements might extend between one end support and a first intermediate support, the first intermediate support and another intermediate support, and the last intermediate support and a second end support, for example. In this regard, the end support 110 of the invention, including its method of assembly and packing, may be applied to a wide variety of products or environments.

The size of the rack 100 may vary, such as depending on the desired application. As one example, the end supports 110 may be about 24 inches wide and 72 inches high and they may be spaced from one another by about 70-80 inches. As indicated however, the dimensions of the rack 100 may vary considerably.

The components of the rack 100 may be constructed from a variety of materials. In a preferred embodiment, the components are constructed from metal, and preferably steel. As indicated, while the cross members 222, 224, 226 are preferably generally "C" shaped in cross-section so that they are strong but have a lighter weight, the cross members could have a closed hollow body construction or even be solid.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A utility rack comprising:

a plurality of shelves; and an end support disposed on each of opposite sides of the plurality of shelves, the end supports being configured to support the shelves, and each end support comprising:

a first vertical support having a first bracket comprising a first attachment point and a second bracket comprising a second attachment point, and a second vertical support having a third bracket comprising a third attachment point and a fourth bracket comprising a fourth attachment point;

a first horizontal support having a first end removably and pivotally connected to the first attachment point and a second end at least one of removably or pivotally connected to the third attachment point, where the first horizontal support is formed having a channel cross section;

a second horizontal support having a first end removably and pivotally connected to the second attachment point and a second end at least one of removably or pivotally connected to the fourth attachment point; and a diagonal support having a first end removably and pivotally connected with the first end of the first horizontal support at the first attachment point and a second end at least one of removably or pivotally connected with the second end of the second horizontal support at the fourth attachment point, where the first horizontal support is configured to receive the first end of the diagonal support into the channel, and surround sides of the diagonal support; and where the first horizontal support, the second horizontal support, and the diagonal support are each configured to be rotatable with respect to the first vertical support from a first position that is substantially parallel to the first vertical support to a second position that is extended at least partially away from the first vertical support for connecting with the second vertical support.

2. The utility rack of claim 1, where each of the first bracket, the second bracket, the third bracket, and the fourth bracket are coupled to an interior surface within the channel of the first or second vertical support.

3. The utility rack of claim 2, where the first horizontal support has a length equal to a length of the second horizontal support, and the diagonal support has a length greater than the first horizontal support.

* * * * *